US005142435A

United States Patent [19]

Baumgartner et al.

[11] Patent Number: 5,142,435

[45] Date of Patent: Aug. 25, 1992

[54] FILTER CAPACITOR PRECHARGE APPARATUS

[75] Inventors: Kenneth A. Baumgartner, Peoria, Ill.; William Pickering, University Heights; Arthur Wild, Thompson, both of Ohio

[73] Assignee: Caterpillar Industrial Inc., Mentor, Ohio

[21] Appl. No.: 533,059

[22] Filed: Jun. 4, 1990

[51] Int. Cl.[5] ..... H01H 47/00

[52] U.S. Cl. ..... 361/160; 361/2; 361/187; 361/195

[58] Field of Search ..... 361/2, 3, 160, 170, 361/179, 189, 190, 186, 187, 194, 195, 196

[56] References Cited

U.S. PATENT DOCUMENTS

| | | | |
|---|---|---|---|
| 3,928,860 | 12/1975 | Numuta et al. | 354/54 |
| 4,008,423 | 2/1977 | Christianson et al. | 318/139 |
| 4,105,367 | 8/1978 | Francis, Jr. | 417/36 |
| 4,125,885 | 11/1978 | Lowther et al. | 361/114 |
| 4,176,388 | 11/1979 | Palmer | 361/196 |
| 4,197,569 | 4/1980 | Millard et al. | 361/250 |
| 4,203,059 | 5/1980 | Kraus | 318/446 |
| 4,581,571 | 4/1986 | Hansen | 320/13 |
| 4,695,784 | 9/1987 | Reynolds | 320/32 |
| 4,713,716 | 12/1987 | Takemura et al. | 361/2 |
| 4,745,515 | 5/1988 | Fowler | 361/185 |
| 4,829,899 | 5/1989 | Wilker et al. | 102/206 |

*Primary Examiner*—Jeffrey A. Gaffin
*Attorney, Agent, or Firm*—David M. Masterson

[57] ABSTRACT

An apparatus is provided for precharging a filter capacitor to prevent damage to a set of contacts resulting from arcing across the contacts. Included is a coil, a set of contacts, and a battery, such that the contacts and filter capacitor are connected in series and the series connected combination is connected in parallel across the battery. Also included is a switch, and a microprocessor for producing a triggering signal responsive to the closure of the switch. A driving circuit receives the triggering signal and responsively produces a charging signal. A charging circuit receives the charging signal and responsively charges the filter capacitor. Thereafter, the microprocessor produces an energizing signal causing the coil to become energized and the contacts to responsively close. By precharging the filter capacitor before the closure of the contacts, the voltage potential across the contacts is reduced. Therefore, no damage occurs due to arcing across the contacts.

14 Claims, 1 Drawing Sheet

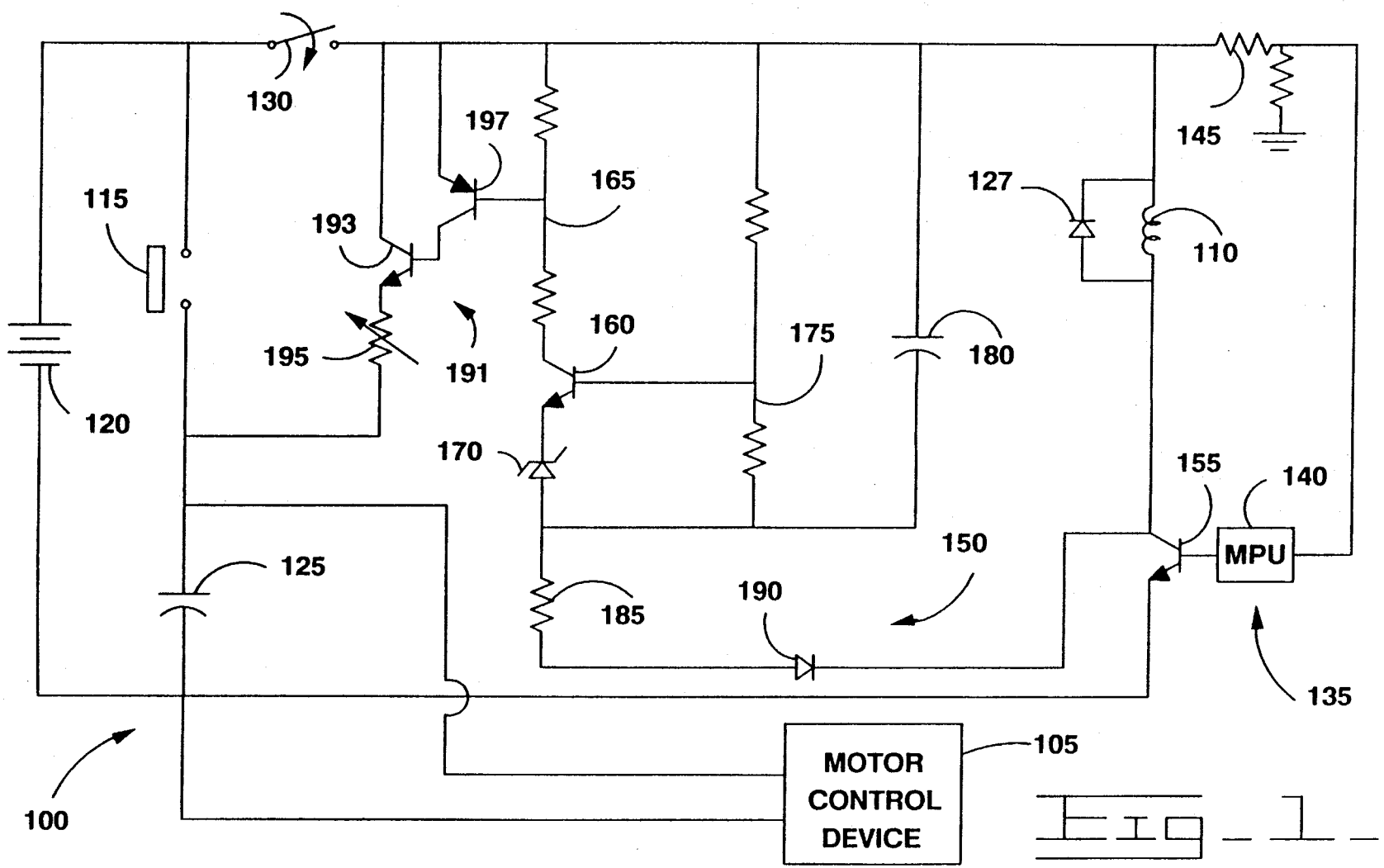
MPU
MOTOR CONTROL DEVICE
100
105
110
115
120
125
127
130
135
140
145
150
155
160
165
170
175
180
185
190
191
193
195
197

FILTER CAPACITOR PRECHARGE APPARATUS

DESCRIPTION

1. Technical Field

This invention relates generally to an apparatus for charging a filter capacitor and more particularly, to a precharging apparatus contained in a lift-truck for charging the filter capacitor prior to the closure of a set of contacts.

2. Background Art

Contactors, such as electro-mechanically operated contactors for example, typically have one or more pairs of contacts and a coil which is energized to close the contacts. Typically, either mechanical or electrical switches are connected in series with the coils. The switches are either open or closed and the coils are responsively energized or deenergized. For example, an electric vehicle such as an electric lift-truck typically has a plurality of motors and other devices performing various functions, each device being supplied with power under the control of an associated contactor.

One problem with the above described contactors is that a high voltage potential exists across the contacts before the contacts close which can cause excessive arcing to occur. In this case the contacts may burn away due to the arcing, and destruction of the contactor can result. Additionally, the contacts may weld together, in which case the motor may not respond to a given command.

Therefore, it is desirable to avoid a high voltage potential across the contacts prior to the closure of the contacts.

The present invention is directed to overcoming one or more of the problems as set forth above.

DISCLOSURE OF THE INVENTION

In one aspect of the present invention, a precharge apparatus for a filter capacitor including a contactor having a coil and at least one pair of contacts movable from an open position to a closed position in response to energizing the coil is disclosed. The coil is energized by a battery having positive and negative terminals, the contacts and filter capacitor are connected in series between the positive battery terminal and the negative battery terminal. A switch having a first position at which the switch is open and a second position at which the switch is closed is connected between the positive battery terminal and the coil. A logic device produces a triggering signal for a preselected amount of time in response to the switch changing from the first position to the second position. A driving circuit receives the triggering signal and responsively produces a charging signal; and a charging circuit receives the charging signal and responsively charges the filter capacitor prior to energizing the coil.

In another aspect of the present invention, a method is provided for precharging a filter capacitor in a system including a contactor having a coil and at least one pair of contacts movable from an open position to a closed position in response to energizing the coil, and a switch having a first position at which the switch is open and a second position at which the switch is closed. The method includes the steps of producing a triggering signal for a preselected amount of time in response to the switch changing from the first position to the second position, receiving the triggering signal and responsively producing a charging signal; and receiving the charging signal and responsively charging the filter capacitor prior to energizing the coil.

Prior circuits often result in a great deal of arcing across a set of contacts as a result of a high voltage differential across the contacts before the closure of the contacts. The present invention provides for a low voltage differential across the set of contacts before the closure of the contacts to prevent arcing.

BRIEF DESCRIPTION OF THE DRAWINGS

FIG. 1 is an electrical schematic of an embodiment of the present invention.

BEST MODE FOR CARRYING OUT THE INVENTION

FIGS. 1 illustrates a precharging apparatus 100 adaptable to be used in, for example, an electric vehicle such as a lift truck, having a motor control device with a plurality of motors 105. The apparatus 100 includes a contactor which has a coil 110 and at least one pair of contacts 115 movable from an open position to a closed position in response to energizing the coil 110, wherein the coil 110 is energized by a battery 120 having positive and negative terminals. In the preferred embodiment the contacts 115 and filter capacitor 125 are connected in series between the positive battery terminal and the negative battery terminal. Additionally, a flyback diode 127 is connected in parallel across the contactor coil 110 to allow the coil 110 to collapse its magnetic field.

A switch 130 is included which has a first position at which the switch is open and a second position at which the switch is closed. Typically, the switch 130 is connected between the positive battery terminal and the coil 110. The switch 130 is, for example, a conventional key switch, a seat operated switch, or a combination thereof selected to initiate operation of the lift truck.

A logic means 135 produces a triggering signal for a preselected amount of time in response to the switch 130 changing from the first position to the second position. More specifically, the triggering signal is a pulse width modulated signal with a preselected duty cycle. The logic means 135 advantageously includes a programmable microprocessor (MPU) 140. Also included is a sensing resistor divider 145 for detecting the position of the switch 130. The sensing resistor divider 145 is connected between the switch 130 and the microprocessor 140.

A driving means 150 receives the triggering signal and responsively produces a charging signal. The driving means 150 includes a first semiconductor switch 155 which is connected between the contactor coil 110 and the negative battery terminal, and is adapted to receive the triggering signal. In the preferred embodiment, the first semiconductor switch 155 is a npn type transistor having a collector connected to the contactor coil 110, an emitter connected to the negative battery terminal, and a base connected to the programmable microprocessor 140. The triggering signal biases the first semiconductor switch 155 "on" and "off" for a preselected amount of time.

The driving means 150 also includes a second semiconductor switch 160 connected between a junction connecting the first semiconductor switch 155 to the contactor coil 110, and the positive battery terminal. More specifically, the second semiconductor switch 160 is a npn type transistor having a collector connected to the positive battery terminal through a first voltage divider 165, an emitter connected to the collector of the first semiconductor switch 155 through a Zener diode 170, and a base connected to a junction between two resistors connected in series. The series connected resistors form a second voltage divider 175 which is connected between the positive battery terminal and the anode of the Zener diode 170. The Zener diode 170 provides a preselected emitter voltage on the second semiconductor switch 160, allowing for a faster turn-off time of the second semiconductor switch 160.

A voltage storage circuit includes a storage capacitor 180, a current limiting resistor 185 and a blocking diode 190. The storage capacitor 180 is connected between the positive battery terminal and the anode of the Zener diode 170. The current limiting resistor 185 is connected to the anode of the Zener diode 170 and to the collector of the first semiconductor switch 155 through the blocking diode 190. The voltage storage circuit provides a d.c. voltage to the base of the second semiconductor switch 160 for the duration of the triggering signal. Therefore, the second semiconductor switch 160 remains biased "on" even though the first semiconductor switch 155 pulses "on" and "off".

A charging means 191 receives the charging signal and responsively charges the filter capacitor 125 prior to energizing the coil 110. The charging means 191 includes a third semiconductor switch 193 connected in series with a resistive element 195. The series connected combination is connected in parallel with the contacts 115. The third semiconductor switch 193 controllably connects and disconnects the resistive element 195 to the positive battery terminal. More specifically, the third semiconductor switch 193 is a npn type transistor having a collector connected to the positive battery terminal, an emitter connected to the resistive element 195, and a base connected to the positive battery terminal through a fourth semiconductor switch 197. The fourth semiconductor switch 197 is a pnp type transistor with an emitter connected to the positive battery terminal, a collector connected to the base of the third semiconductor switch 193 and a base connected to the junction between the series connected resistors composing the first voltage divider 165. The third and fourth semiconductor switches 193, 197 are connected in a compound-pnp configuration providing for a high current gain in a manner that is well known in the art.

Preferably, the resistive element 195 is a positive temperature coefficient device which limits current flowing through the third semiconductor switch 193. More specifically, the resistive element 195 chosen increases in resistance as its temperature exceeds a preselected value. The temperature is proportional to the current flowing through the resistive element 195.

Industrial Applicability

Typically, a vehicle operator moves the switch 130 from the first position to the second position in which the switch 130 closes. In response, a voltage potential exists across the sensing resistor divider 145 and a corresponding voltage signal is delivered to the microprocessor 140. Thus, the voltage signal is representative of the switch 130 being at the second position. In another instance, the switch 130 may be a series of switches (not shown). For example, a seat switch may be connected in series with a key switch, wherein the series connected switches are between the positive battery terminal and the sensing resistor divider 145. The vehicle operator typically closes the key switch; however, a voltage signal is not produced until the operator engages the seat switch to the closed position. Therefore, the combination of the key switch and the seat switch may assume the role of the switch 130.

Next, the microprocessor 140 responsively produces a triggering signal which is received by the first semiconductor switch 155. The triggering signal is a pulsed signal which biases the first semiconductor switch 155 "on" and "off". However, the triggering signal duty cycle is insufficient to energizing the coil 110 to a level which causes the contacts 115 to move from the open position to the closed position More specifically, the duty cycle's "high" condition is of a short duration compared to the "low" condition such that the contactor coil 110 is not able to fully energize. However, the second semiconductor switch 160 is biased "on" throughout the duration of the triggering signal. More particularly, when the triggering signal is "high" the first semiconductor switch 155 is biased "on" and a current path exists through the first and second voltage dividers 165, 175 to the negative battery terminal, thereby biasing the second semiconductor switch 160 "on". Conversely, when the triggering signal is "low" the first semiconductor switch 155 is biased "off". When this occurs the voltage stored across the storage capacitor 180 discharges through the first and second voltage dividers 165, 175 keeping the second semiconductor switch 160 biased "on".

The third and fourth semiconductor switches 193, 197 form a compound-pnp configuration. The fourth semiconductor switch 197 drives the third semiconductor switch 193 to the conducting state. The fourth semiconductor switch 197 remains biased "on" as long as the second semiconductor switch 160 is biased "on". As stated earlier, the fourth semiconductor switch 197 drives the third semiconductor switch 193 allowing current to travel through the third semiconductor switch 193 and the resistive element 195 to charge the filter capacitor 125. In this manner, the filter capacitor 125 obtains a sufficient amount of voltage which is essentially equivalent to the battery voltage.

After the preselected amount of time, the logic means 135 stops producing the triggering signal and produces the energizing signal. More specifically, the preselected amount of time the triggering signal is produced is based on the RC time constant of the filter capacitor 125 and the resistive element 195 to sufficiently charge the filter capacitor 125. The energizing signal is of a constant magnitude and biases the first semiconductor switch 155 "on" and responsively energizes the contactor coil 110. However unlike prior systems, no arcing occurs when the contacts 115 close. This is due to the filter capacitor 125 holding a voltage value which causes a small voltage differential to exist across the contacts 115 before the contacts 115 close.

Other aspects, objects and advantages of the invention can be obtained from a study of the drawing, the disclosure and the appended claims.

We claim:

1. A precharge apparatus for a filter capacitor including a contactor having a coil and at least one pair of contacts movable from an open position to a closed position in response to energizing the coil, said coil being energized by a battery having positive and negative terminals, said contacts and filter capacitor being connected in series between said positive battery terminal and said negative battery terminal, comprising:

a switch having a first position at which said switch is open and a second position at which said switch is closed, said switch being connected between said positive battery terminal and said coil;

logic means for producing a triggering signal for a preselected amount of time in response to said switch changing from said first position to said second position;

driving means for receiving said triggering signal and responsively producing a charging signal; and charging means for receiving said charging signal and responsively charging said filter capacitor prior to energizing said coil.

2. An apparatus, as set forth in claim 1, wherein said triggering signal is a pulse width modulated signal with a preselected duty cycle.

3. An apparatus, as set forth in claim 2, wherein said triggering signal's duty cycle is insufficient to cause said coil to energize and cause said contacts to move from said open position to said closed position.

4. An apparatus, as set forth in claim 1, wherein said driving means includes a first semiconductor switch connected between said contactor coil and said negative battery terminal, and adapted to receive said triggering signal.

5. An apparatus, as set forth in claim 4, wherein said logic means also produces a energizing signal after said preselected amount of time.

6. An apparatus, as set forth in claim 5, wherein said first semiconductor switch receives said energizing signal and responsively energizes said contactor coil.

7. An apparatus, as set forth in claim 1, wherein said logic means includes a programmable microprocessor connected to said first semiconductor switch.

8. An apparatus, as set forth in claim 1, wherein said driving means includes a second semiconductor switch connected between a junction connecting said first semiconductor switch to said contactor coil, and said positive battery terminal.

9. An apparatus, as set forth in claim 1, wherein said charging means includes a third semiconductor switch connected in series with a resistive element, said series connected combination being connected in parallel with said contacts.

10. An apparatus, as set forth in claim 9, wherein said third semiconductor switch controllably connects and disconnects said resistive element to said positive battery terminal.

11. An apparatus as set forth in claim 9, wherein resistive element is a positive temperature coefficient device.

12. A precharge apparatus for a filter capacitor including a contactor having a coil and at least one pair of contacts movable from an open position to a closed position in response to energizing the coil, said coil being energized by a battery having positive and negative terminals, said contacts and filter capacitor being connected in series between said positive battery terminal and said negative battery terminal, comprising:

a switch connected between said positive battery terminal and said coil;

a first semiconductor switch connected between said contactor coil and said negative battery terminal;

a programmable microprocessor connected to said first semiconductor switch;

a second semiconductor switch connected between a junction connecting said first semiconductor switch to said contactor coil, and said positive battery terminal; and a third semiconductor switch connected in series with a resistive element, said series connected combination being connected in parallel with said contacts.

13. A method for precharging a filter capacitor in a system including a contactor having a coil and at least one pair of contacts movable from an open position to a closed position in response to energizing the coil, and a switch having a first position at which said switch is open and a second position at which said switch is closed, comprising the steps of:

producing a triggering signal for a preselected amount of time in response to said switch changing from said first position to said second position;

receiving said triggering signal and responsively producing a charging signal; and receiving said charging signal and responsively charging said filter capacitor prior to energizing said coil.

14. A method, as set forth in claim 13, including the steps of:

producing an energizing signal after said preselected amount of time; and receiving said energizing signal and responsively energizing said contactor coil.

* * * * *